US009992599B2

(12) United States Patent
Van Loon et al.

(10) Patent No.: US 9,992,599 B2
(45) Date of Patent: Jun. 5, 2018

(54) METHOD, DEVICE, ENCODER APPARATUS, DECODER APPARATUS AND AUDIO SYSTEM

(75) Inventors: Machiel Willem Van Loon, Eindhoven (NL); Gerard Herman Hotho, Eindhoven (NL); Dirk Jeroen Breebaart, Eindhoven (NL)

(73) Assignee: Koninklijke Philips N.V., Eindhoven (NL)

( * ) Notice: Subject to any disclaimer, the term of this patent is extended or adjusted under 35 U.S.C. 154(b) by 2135 days.

(21) Appl. No.: 10/599,560

(22) PCT Filed: Mar. 30, 2005

(86) PCT No.: PCT/IB2005/051065

§ 371 (c)(1),
(2), (4) Date: Oct. 2, 2006

(87) PCT Pub. No.: WO2005/098826

PCT Pub. Date: Oct. 20, 2005

(65) Prior Publication Data

US 2007/0183601 A1 Aug. 9, 2007

(30) Foreign Application Priority Data

Apr. 5, 2004 (EP) ..... 04101405
Jul. 14, 2004 (EP) ..... 04103367

(51) Int. Cl.
*H04R 5/00* (2006.01)
*H04S 3/00* (2006.01)
(Continued)

(52) U.S. Cl.
CPC ..... *H04S 3/008* (2013.01); *G10L 19/008* (2013.01); *H04S 3/02* (2013.01); *H04S 2420/03* (2013.01)

(58) Field of Classification Search
CPC ... H04S 3/00; H04S 3/02; H04S 5/005; H04S 2420/03; H04S 3/008; G10L 19/008; H04H 20/48; H04H 20/88; H04H 20/89
(Continued)

(56) References Cited

U.S. PATENT DOCUMENTS 4,095,049 A * 6/1978 Gerzon ..... 381/20
4,236,039 A * 11/1980 Cooper ..... 381/23
(Continued)

FOREIGN PATENT DOCUMENTS

WO 9526083 A1 9/1995
WO WO9526083 A1 9/1995
(Continued)

OTHER PUBLICATIONS

Faller et al: "Binaural-Cue Coding—Part II: Schemes and Applications"; IEEE Transactions on Speech and Audio Processing, vol. 11, No. 6, Nov. 2003, pp. 520-531.
(Continued)

*Primary Examiner* — Xu Mei

(57) ABSTRACT

Method for processing a stereo signal includes encoding an N-channel audio signal in a stereo signal (Lo, Ro) and spatial parameters (wl, wr), processing the stereo signal using the spatial parameters for generating a processed stereo signal (low, Row). The matrix of the processed stereo signal is described as the matrix of the stereo signal, multiplied by a filter matrix (H) having element that are filter functions (H1, H2, H3, H4) operated with spatial parameters (wl, wr) and a constant (a). The filter functions are time invariant and selected so that the matrix is invertible.

24 Claims, 2 Drawing Sheets

(51) Int. Cl.
*G10L 19/008* (2013.01)
*H04S 3/02* (2006.01)

(58) Field of Classification Search
USPC ..... 381/23, 22, 17–20, 1; 704/500
See application file for complete search history.

(56) References Cited

U.S. PATENT DOCUMENTS

| | | | | |
|---|---|---|---|---|
| 5,818,941 | A | 10/1998 | Embree | |
| 6,154,545 | A * | 11/2000 | Kohut et al. | 381/23 |
| 6,173,061 | B1 * | 1/2001 | Norris et al. | 381/309 |
| 6,205,430 | B1 | 3/2001 | Hui | |
| 6,697,491 | B1 | 2/2004 | Griesinger | |
| 7,447,317 | B2 * | 11/2008 | Herre et al. | 381/23 |
| 2003/0236583 | A1 | 12/2003 | Baumgarte et al. | |
| 2005/0195981 | A1 * | 9/2005 | Faller et al. | 381/23 |
| 2007/0230710 | A1 * | 10/2007 | Van Loon et al. | 381/23 |

FOREIGN PATENT DOCUMENTS

| | | | |
|---|---|---|---|
| WO | 9851126 | A1 | 11/1998 |
| WO | WO2004008805 | A1 | 1/2004 |
| WO | 2005098821 | A2 | 10/2005 |
| WO | 2005988241 | A1 | 10/2005 |

OTHER PUBLICATIONS

Schuijers et al: "Advances in Parametric Coding for High-Quality Audio"; AES Convention, Paper 5852, Mar. 2003, pp. 1-11.
Hawksford: "Scalable Multichannel Coding With HRTF Enhancement for DVD and Virtual Sound Systems": J. Audio Eng. Soc., vol. 50, No. 11, pp. 894-913.
Warner Ten Kate: "Compatibility Matrixing of Multichannel Bit-Rate Reduced Audio Signals"; J. Audio Eng. Soc., vol. 44, No. 12, Dec. 1996, pp. 1104-1119.
Warner Ten Kate: "A New Surround-Stereo-Surround Coding Technique"; J. Audio Eng. Soc., vol. 40, No. 5, 1992, pp. 376-383.

* cited by examiner

METHOD, DEVICE, ENCODER APPARATUS, DECODER APPARATUS AND AUDIO SYSTEM

The present invention relates to a method and device for processing a stereo signal obtained from an encoder, which encoder encodes an N-channel audio signal into left and right signals and spatial parameters. The invention also relates to an encoder apparatus comprising such an encoder and such a device.

The present invention also relates to a method and device for processing a stereo signal obtained by such a method and such a device for processing a stereo signal obtained from an encoder. The invention also relates to a decoder apparatus comprising such a device for processing a stereo signal.

The present invention also relates to an audio system comprising such an encoder apparatus and such a decoder apparatus.

For a long time, stereo reproduction of music, for example in home environment has been prevailing. During the 1970's, some experiments were done with four channel reproduction of home music equipment.

In larger halls, such as film theatres, multi-channel reproduction of sound has been present for a long time. Dolby Digital® and other systems were developed for providing realistic and impressive sound reproduction in a large hall.

Such multi-channel systems have been introduced in the home theatre and are gaining large interest. Thus, systems having five full-range channels and one part-range channel or low-frequency effects (LFE) channel, so called 5.1 systems, are today common on the market. Other systems also exist, such as 2.1, 4.1, 7.1 and even 8.1.

With the introduction of SACD and DVD, multi-channel audio reproduction is gaining further interest. Many consumers already have the possibility of multi-channel playback in their homes, and multi-channel source material is becoming popular.

Because of increased popularity of multi-channel material, efficient coding of multi-channel material is becoming more important, which is also recognized by standardization bodies such as MPEG.

Previously known encoders often do not apply efficient methods to encode multi-channel audio. The input channels may be basically encoded individually (possibly after matrixing), thus requiring a high bit rate due to the large number of channels.

However, a multi-channel audio encoder may generate a 2-channel down-mix which is compatible with 2-channel reproduction systems, while still enabling high-quality multi-channel reconstruction at the decoder side. The high-quality reconstruction is controlled by transmitted parameters P which control the stereo-to-multi-channel upmix process. These parameters contain information describing, amongst others, the ratio of front versus surround signal which is present in the 2-channel down mix. Using such an approach, a decoder can control the amount of front versus surround signal in the upmix process. In other words, the parameters describe important properties of the spatial sound field which was present in the original multi-channel signal, but which is lost in the stereo mix due to the down-mix process.

The current invention relates to the possibility to use this parameterized spatial information to apply parameter-dependent, preferably invertible, post-processing on a 2-channel down-mix to enhance the downmix, such as the perceptual quality or spatial properties thereof.

An object of the present invention is to make post-processing of the down-mix possible after encoding, based upon the parameters as determined in the multi-channel encoder and still maintain the possibility of multi-channel decoding without influences of the post-processing.

This object is achieved by a method and a device for processing a stereo signal obtained from an encoder, which encoder encodes an N-channel (N>2) signal into left and a right signals and spatial parameters. The method comprises processing of said left and right channel signals in order to provide processed signals. The processing is controlled in dependence of said spatial parameters. The general idea is to use the spatial parameters obtained from an N-channel-to-stereo coder to control a certain post-processing algorithm. In this way, the stereo signal obtained from the encoder may be processed, for example for enhancing the spatial impression.

In an embodiment of the invention, the processing is controlled by a first parameter for each input channel, i.e. for each of the left and right signals, which first parameter is dependent on the spatial parameters. The first parameter may be a function of time and/or frequency. Thus, the system may have a variable amount of post-processing of which the actual amount of post-processing depends on the spatial parameters. The post-processing may be performed individually in different frequency bands. The encoder delivers independent spatial parameters describing the spatial image for a set of frequency bands. In that case, the first parameter may be frequency-dependent.

In another embodiment of the invention, the post-processing comprises adding a first, second and third signal in order to obtain said processed channel signals. The first signal includes the first input signal, i.e. the left or right signal, modified by a first transfer function, the second signal includes the first input signal modified by a second transfer function, and the third signal includes the second input signal, i.e. the right or left signal, modified by a third transfer function. The second transfer function may comprise said first parameter and a first filter function. The first transfer function may comprise a second parameter, whereby the sum of said first parameter and said second parameter can be unity. The third transfer function may comprise said first parameter of the second input signal and a second filter function.

The filter functions may be time-invariant.

In one specific embodiment, the signals may be described by the equation:

$$\begin{bmatrix} L_{Ow} \\ R_{Ow} \end{bmatrix} = H \begin{bmatrix} L_O \\ R_O \end{bmatrix} \text{ in which:}$$

$$H = \begin{bmatrix} (1-w_l)^a + (w_l)^a H_1 & (w_r)^a H_3 \\ (w_l)^a H_2 & (1-w_r)^a + (w_r)^a H_4 \end{bmatrix}$$

with $\alpha$ being a constant.

Using this representation, the filtering effect of the filter functions $H_1$, $H_2$, $H_3$ and $H_4$ is variable by varying the parameters $w_l$, and $w_r$. If both parameters have values equal to zero, the post-processed signals $L_{0w}$, $R_{0w}$ are essentially equal to the stereo input signal pair $L_0$, $R_0$. On the other hand, if the parameters are +1, the post-processed stereo pair $L_{0w}$, $R_{0w}$, is fully processed by the filter functions $H_1$, $H_2H_3$ and $H_4$. This invention makes possible to control the actual amount of filtering, i.e., the value of the parameters $w_l$, and $w_r$ by the spatial parameters P.

According to an embodiment, the filter functions and parameters are selected so that the transfer function matrix is invertible. This makes reconstruction of the original stereo signal possible.

In another aspect of the invention, it comprises a device for processing a stereo signal in accordance with the above mentioned methods, and an encoder apparatus comprising such a device.

In another aspect of the invention there is provided a method and a device for inverting the processing in accordance with the above mentioned methods, and a decoder apparatus comprising such an inverting device.

In yet another aspect of the invention there is provided an audio system comprising such an encoder apparatus and such a decoder apparatus.

Further objects, features and advantages of the invention will appear from the following detailed description of the invention with reference to embodiments thereof and with reference to the appended drawings, in which.

Figure 1:
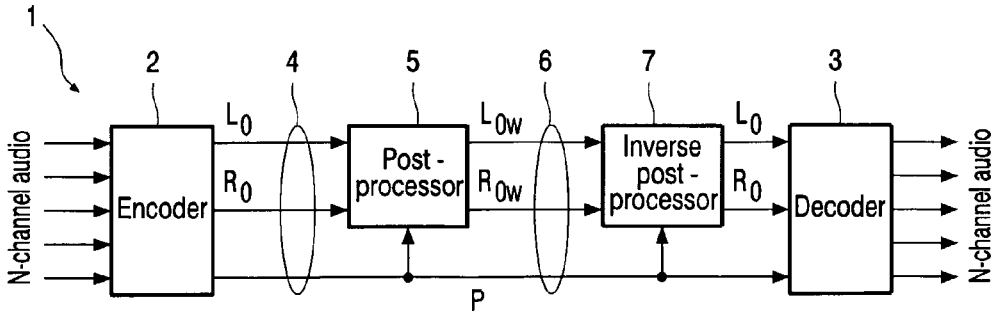
FIG. 1 shows a schematic block diagram of an encoder/decoder audio system including post-processing and inverse post-processing according to the present invention.

FIG. 1 is a block diagram of an encoder/decoder system in which the present invention is intended to be used. In the audio system 1 an N-channel audio signal is supplied to an encoder 2, with N being an integer which is larger than 2. The encoder 2 transforms the N-channel audio signals to signals $L_0$ and $R_0$ and parametric decoder information P, by means of which a decoder can decode the information and estimate the original N-channel signals to be output from the decoder. The spatial parameter set P is preferably time and/or frequency dependent. The N-channel signals may be signals for a 5.1 system, comprising a center channel, two front channels, two surround channels and an LFE channel.

The encoded stereo signal pair $L_0$ and $R_0$ and decoder spatial information P, are transmitted to the user in a suitable way, such as by CD, DVD, VHS Hi-Fi, broadcast, laser disc, DBS, digital cable, Internet or any other transmission or distribution system, indicated by the circle line 4 in FIG. 1. Since the left and right signals are transmitted, the system is compatible with the vast number of receiving equipment that can only reproduce stereo signals. If the receiving equipment includes a decoder, the decoder may decode the N-channel signals and provide an estimate thereof, based on the information in the stereo signal pair $L_0$ and $R_0$ as well as the decoder spatial information signals or spatial parameters P.

However, due to the decreased number of playback signals, stereo signals are lacking spatial information compared to the N-channel signals or other properties that may be desired for certain situations. Thus, according to the present invention, there is provided a post-processor 5 which processes the stereo signal prior to the transmission/distribution to the receiver. The post-processing may be position-dependent "addition" of bass or reverberation, or removal of vocals (karaoke with vocals in center channel).

Other examples of post-processing are stereo-base-widening, which may be performed by making use of the knowledge of the composition of the original surround mix, such as front/back, since the contribution of individual input signals is known from the decoder information signals P. In principle, stereo widening can be applied already in the encoder, but this is generally not invertible, since only two signals are available in the decoder, instead of N, inversion is generally impossible. But besides stereo widening, also other post-processing techniques on the individual multi-channel contributions are possible.

According to the invention, the post-processed signals are transmitted to a receiver as indicated by the circle 6 in FIG. 1. The inventive device for processing a stereo signal obtained from an encoder comprises the post-processor 5. The encoder apparatus according to the present invention comprises the encoder 2 and the post-processor 5.

The signal received may be used directly, for example if the receiver does not include a multi-channel decoder. This may be the case in a computer receiving the signal 6 over the Internet, or in a receiver having only two loudspeakers. Such received signal is perceived as a high quality signal, since it has improved spatial impression or other characteristics as determined in the processing thereof by the encoder and the post-processor.

If the signal should be used for decoding in a conventional N-channel decoder 3, it must first be inverse post-processed by an inverse post-processor 7, in order to reconstruct the original stereo signal pair $L_0$ and $R_0$ which together with the decoder information or spatial parameters P, produces an estimated N-channel signal. According to the invention, such reconstruction is possible of the multi-channel mix, which reconstruction is hardly affected by the post-processing. Also post-processing in the decoder is possible for stereo playback as a user-selectable feature, without the necessity to determine the multi-channel signal first. The inventive device for processing a stereo signal comprising left and right signals comprises the inverse post-processor 7. The decoder apparatus according to the present invention comprises the decoder 3 and the inverse post-processor 7.

Without post-processing the down-mix is comparable with a standard ITU down-mix. The inventive method, however, may improve the down-mix significantly.

The inventive method is able to determine the contribution in the down-mix of the original channels in the multi-channel mix with the help of the determined spatial parameters P in the encoder. In this way post-processing can be applied to specific channels of the multi-channel mix, for example stereo-base-widening of the rear channels, whilst the other channels are not affected. The post-processing does not affect the final multi-channel reconstruction if the post-processing is invertible. It can also be applied for an improved stereo playback without the necessity to reconstruct the multi-channel mix first.

This method differs from existing post-processing techniques in that it uses the knowledge of the original multi-channel mix, i.e. the determined spatial parameters P.

The encoder 2 operates in the following way:

Assume an N-channel audio signal as an input signal to the encoder 2, where $z_1[n]$, $z_2[n]$, . . . $z_N[n]$ describe the discrete time-domain waveforms of the N channels. These N signals are segmented using a common segmentation, preferably using overlapping analysis windows. Subsequently, each segment is converted to the frequency domain using a complex transform (e.g., FFT). However, complex filter-bank structures may also be appropriate to obtain time/frequency tiles. This process results in segmented, sub-band representations of the input signals which will be denoted by, $Z_1[k]$, $Z_2[k]$, . . . , $Z_N[k]$, with k denoting the frequency index.

From these N channels, 2 down-mix channels are created, being $L_0[k]$ and $R_0[k]$. Each down-mix channel is a linear combination of the N input signals:

$$L_O[k] = \sum_{i=1}^{N} \alpha_i Z_i[k]$$

$$R_O[k] = \sum_{i=1}^{N} \beta_i Z_i[k].$$

The parameters $\alpha_i$ and $\beta_i$ are chosen such that the stereo signal consisting of $L_0[k]$ and $R_0[k]$ has a good stereo image. In case of a 5-channel input signal consisting of $L_f$, $R_f$, C, $L_s$, and $R_s$ (for the left-front, right-front, center, left-surround, right-surround channels, respectively), a suitable downmix can be obtained according to:

$$L_0[k]=L[k]+C[k]/\sqrt{2}$$

$$R_0[k]=R[k]+C[k]/\sqrt{2}$$

The signals L and R can be obtained according to the equations:

$$L[k]=L_f[k]+L_s[k]/\sqrt{2}$$

$$R[k]=R_f[k]+R_s[k]/\sqrt{2}$$

Additionally, spatial parameters P are extracted to enable perceptual reconstruction of the signals $L_f$, $R_f$, C, $L_s$ and $R_s$, from $L_0$ and $R_0$.

In an embodiment, the parameter set P includes inter-channel intensity differences (IIDs) and possibly inter-channel cross-correlation (ICCs) values between the signal pairs ($L_f$, $L_s$) and ($R_f$, $R_s$). The IID and ICC between the Lf, Ls pair are obtained according to the equations:

$$IID_L = \frac{\sum_k L_f[k]L_f^*[k]}{\sum_k L_s[k]L_s^*[k]}$$

$$ICC_L = \Re\left(\frac{\sum_k L_f[k]L_s^*[k]}{\sqrt{\sum_k L_f[k]L_f^*[k]\sum_k L_s[k]L_s^*[k]}}\right)$$

Here, (*) denotes the complex conjugation. For other signal pairs, similar equations can be used. Thus, the parameter $IID_l$ describes the relative amount of energy between the left-front and left-surround channels and the parameter $ICC_l$ describes the amount of mutual correlation between the left-front and left-surround channels. These parameters essentially describe the perceptually relevant parameters between front and surround channels.

A parameterization of the amount of center signal which is present in $L_0$, $R_0$ can be obtained by estimating two prediction parameters $c_1$, and $c_2$. These two prediction parameters define a 2×3 matrix which controls the decoder upmix process from $L_0$, $R_0$ to L, C, and R;

$$\begin{bmatrix} L \\ R \\ C \end{bmatrix} = M \begin{bmatrix} L_0 \\ R_0 \end{bmatrix}$$

An implementation of the upmix matrix M is given by:

$$M = \begin{bmatrix} c_1 & c_2 - 1 \\ c_1 - 1 & c_2 \\ 1 - c_1 & 1 - c_2 \end{bmatrix}$$

For the example shown above, the parameter set P includes $\{c_1, c_2, IID_l, ICC_l, IID_r, ICC_r\}$ for each time/frequency tile.

On the resulting stereo signal pair ($L_0$, $R_0$), post-processing can be applied in a way that it mainly affects the contribution of $Z_i[k]$, for example $L_s$, and $R_s$, in the stereo mix. In FIG. 1 the position of this block in the codec is shown.

Figure 2:
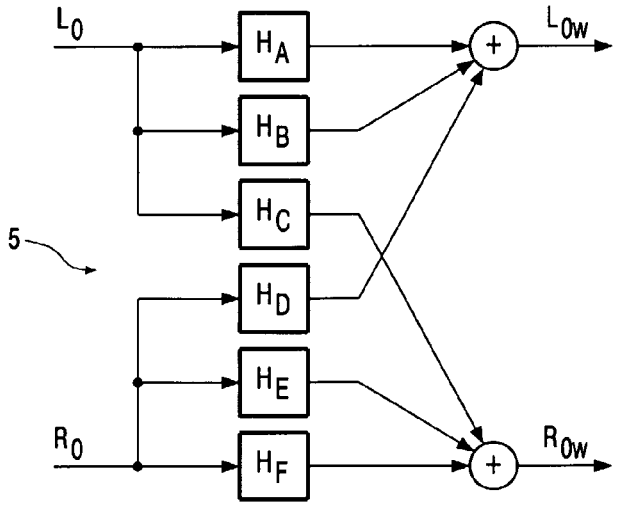
FIG. 2 shows a detailed block diagram of an embodiment of a device for post-processing a stereo signal obtained from a multichannel encoder.

FIG. 2 is a detailed view of the post-processor 5 in FIG. 1 according to an embodiment of the invention. The post-processed left signal $L_{0w}$, is the sum of three signals, namely the left signal $L_0$ modified by a transfer function $H_A$, the left signal $L_0$ modified by a transfer function $H_B$ and the right signal $R_0$ modified by a transfer function $H_D$. In the same way, the post-processed right signal $R_{0w}$ is the sum of three signals, namely the right signal $R_0$ modified by a transfer function $H_F$, the right signal $R_0$ modified by a transfer function $H_E$ and the left signal $L_0$ modified by a transfer function $H_C$. The transfer functions $H_A$-$H_F$ may be implemented as FIR or IIR-type filters, or can simply be (complex) scale factors which may be frequency dependent. Furthermore, the transfer function $H_A$ may be a multiplication with a second parameter ($1-w_l$) and transfer function $H_B$ may include a first parameter $w_l$ whereby this parameter $w_l$ determines the amount of post-processing of the stereo signal.

Figure 3:
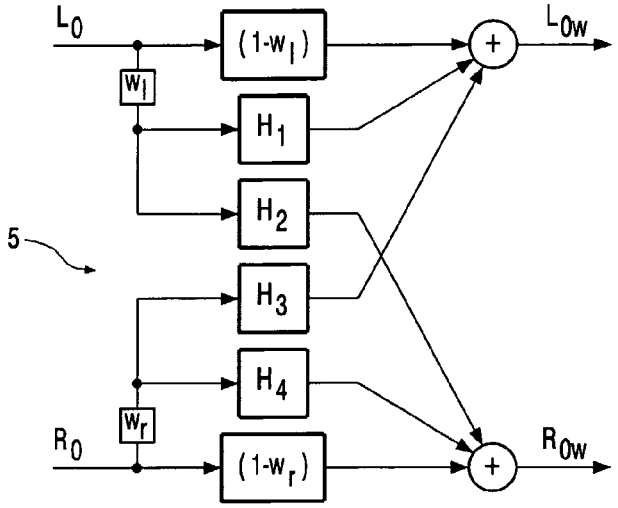
FIG. 3 shows a block diagram of another embodiment of the device for post-processing processing a stereo signal obtained from a multichannel decoder.

This is shown in FIG. 3. The parameter $w_l$ determines the amount of post-processing of $L_0[k]$ and $w_r$ of $R_0[k]$. When $w_l$ is equal to 0, $L_0[k]$ is unaffected, and when $w_l$ is equal to 1, $L_0[k]$ is maximally affected. The same holds for $w_r$ with respect to $R_0[k]$.

The following equations hold for the post-processing parameters $w_l$ and $w_r$:

$$w_l=f_l(IID_l,ICC_l,c1,c2)$$

$$w_r=f_r(IID_r,ICC_r,c1,c2)$$

The blocks $H_1$, $H_2$, $H_3$ and $H_4$ in FIG. 3 are filter functions, which can be various types of filters, for example stereo widening filters, as shown below.

The resulting outputs are:

$$\begin{bmatrix} L_{Ow} \\ R_{Ow} \end{bmatrix} = H \begin{bmatrix} L_O \\ R_O \end{bmatrix} \text{ in which:}$$

$$H = \begin{bmatrix} (1 - w_l)^a + (w_l)^a H_1 & (w_r)^a H_3 \\ (w_l)^a H_2 & (1 - w_r)^a + (w_r)^a H_4 \end{bmatrix}$$

with α an arbitrary constant (e.g., +1).

If the filter functions $H_1$, $H_2$, $H_3$ and $H_4$ are chosen properly, the transfer function matrix H can be inverted. Moreover, to enable computation of the inverse matrix at the decoder side, the filter functions $H_1$, $H_2$, $H_3$ and $H_4$ and parameters $w_l$ and $w_r$ should be known at the decoder. This is possible since $w_l$ and $w_r$ can be calculated from the transmitted parameters. Thus, the original stereo signal $L_0$, $R_0$ will be available again which is necessary for decoding of the multi-channel mix.

Another possibility is to transmit the original stereo signal and apply the post-processing in the decoder to make improved stereo playback possible without the necessity to determine the multi-channel mix first.

Below, an embodiment of the post-processing is described in detail. However, the invention is not limited to the exact details but may be varied within the scope of invention as defined in the appended patent claims.

The post-processing parameters or weights $w_l$, and $w_r$ are a function of the transmitted spatial parameters:

$$(w_1, w_r) = f(P)$$

The function f is designed in such a way that $w_l$, increases if the signal $L_0$ contains more energy from the left-surround signal compared to the left-front or center signals. In a similar way, $w_r$ increases with increasing relative energy of the right-surround signal present in $R_0$. A convenient expression for $w_l$, and $w_r$ is given by:

$$w_l = f_1(c_1) f_2(IID_l)$$

$$w_r = f_1(c_2) f_2(IID_r)$$

with $$f_1(x) = \begin{cases} 2x - 1 & \text{for } 0.5 \le x \le 1 \\ 0 & \text{for } x < 0.5 \\ 1 & \text{for } x > 1 \end{cases}$$

and $$f_2(x) = \sqrt{\frac{x}{1+x}}$$

For the filter functions $H_1$, $H_2$, $H_3$, and $H_4$ the following exemplary functions are then chosen (in the z-domain):

$$H_1(z) = H_4(z) = 0.8(1.0 + 0.2z^{-1} + 0.2z^{-2})$$

$$H_2(z) = H_3(z) = 0.8(-1.0z^{-1} - 0.2z^{-2}).$$

This invention can be integrated in a multi-channel audio encoder apparatus that creates a stereo-compatible down-mix. The general scheme of such a multi-channel parametric audio encoder which is enhanced by the post-processing scheme as described above can be outlined as follows:

- Conversion of the multi-channel input signal to the frequency domain, either by segmentation and transform or by applying a filterbank;
- Extraction of spatial parameters P and generation of a down-mix in the frequency domain;
- Application of the post-processing algorithm in the frequency domain; Conversion of the post-processed signals to the time domain;
- Encoding the stereo signal using conventional coding techniques, such as defined in MPEG;
- Multiplexing the stereo bit-stream with the encoded parameters P to form a total output bit-stream.

A corresponding multi-channel decoder apparatus (i.e., a decoder with integrated post-processing inversion) can be outlined as follows:

- Demultiplexing the parameter bit-stream to retrieve the parameters P and the encoded stereo signal;
- Decoding the stereo signal;
- Conversion of the decoded stereo signal to the frequency domain;
- Applying the post-processing inversion based on the parameters P;
- Upmix from stereo to multi-channel output based on the parameters P;
- Conversion of the multi-channel output to the time domain.

Since the post-processing and inverse post-processing are performed in the frequency domain, the filter functions $H_1$ to $H_4$ are preferably converted or approximated in the frequency domain by simple (real-valued or complex) scale factors, which may be frequency dependent.

Those skilled in the art may understand that one or more processing stages as outlined above may be combined as a single processing stage.

Another application of the invention is to apply the post-processing on the stereo signal at the decoder-side only (i.e., without post-processing at the encoder side). Using this approach, the decoder can generate an enhanced stereo signal from a non-enhanced stereo signal.

Extra information can be provided in the bit-stream which signals whether or not the post-processing has been done and the parameter functions $f_1$, $f_2$ and which filter functions $H_1$, $H_2$, $H_3$, and $H_4$ have been used, which enables inverse post-processing.

A filter function may be described as a multiplication in the frequency domain. Since parameters are present for individual frequency bands, the invention may be implemented as simple, complex gains instead of filters, which are applied individually in different frequency bands. In this case, frequency bands of $L_{0w}$, $R_{0w}$ are obtained by a simple (2×2) matrix multiplication from corresponding frequency bands from $(L_0, R_0)$. The actual matrix entries are determined by the parameters and frequency domain representations of the filter functions H thus consisting of the time-invariant gains H and a time/frequency-variant parameter-controlled gains $w_l$, and $w_r$. Because the filters are scalars for each band, inversion is possible.

The post-processing in the encoder can be described by the following matrix equation:

$$\begin{bmatrix} L_{Ow} \\ R_{Ow} \end{bmatrix} = H \begin{bmatrix} L_O \\ R_O \end{bmatrix},$$

where $$H = \begin{bmatrix} h_{11} & h_{12} \\ h_{21} & h_{22} \end{bmatrix} = \begin{bmatrix} (1 - w_l)^a + (w_l)^a H_1 & (w_r)^a H_3 \\ (w_l)^a H_2 & (1 - w_r)^a + (w_r)^a H_4 \end{bmatrix}$$

This matrix equation is applied for each frequency band. The matrix H contains of all scalars. The use of scalars makes post-processing and the inverse post-processing relatively easy.

The parameters $w_l$ and $w_r$, are scalars and functions of the parameter set P. These 2 parameters determine the amount of post-processing of the input channels.

The parameters $H_1 \ldots H_4$ are complex filter functions.

The inversion of this process can also be done by a simple matrix multiplication per frequency band. The following equation is applied per frequency band:

$$\begin{bmatrix} L_O \\ R_O \end{bmatrix} = H^{-1} \begin{bmatrix} L_{Ow} \\ R_{Ow} \end{bmatrix}$$

where $$H^{-1} = \begin{bmatrix} k_1 & k_3 \\ k_2 & k_4 \end{bmatrix} = \frac{1}{h_{11}h_{22} - h_{12}h_{21}} \begin{bmatrix} h_{22} & -h_{12} \\ -h_{21} & h_{11} \end{bmatrix}$$

The matrix H.sup.−1 contains only scalars. The elements of $H^{-1}$, $k_1 \ldots k_4$, are also functions of the parameter set P. When the functions in the matrix H, $h_{11} \ldots h_{22}$, and the parameters P are known in the decoder, then the post-processing can be inverted.

Figure 4:
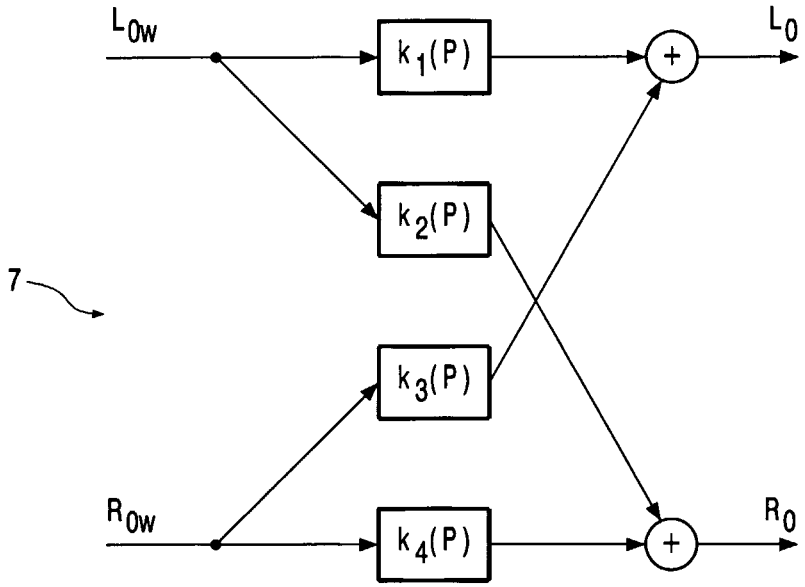
FIG. 4 shows a block diagram of an embodiment of the for inversely post-processing processing a stereo signal comprising left and right signals.

A block diagram of an inverse post-processor 3 which performs such inverse post-processing is illustrated in FIG. 4.

This inversion is possible when the determinant of the matrix H is not equal to zero. The determinant of H is equal to:

$$\det(H)=h_{11}h_{22}-h_{12}h_{21}=(1-w_l)^a(1-w_r)^a+(1-w_l)^a w_r^a H_4+(1-w_r)^a w_l^a H_1+w_l^a w_r^a(H_1H_4-H_2H_3)$$

When suitable functions $h_{11} \ldots h_{22}$ are chosen, det(H) will be unequal zero, so the process is invertable.

It is mentioned that the expression "comprising" does not exclude other elements or steps and that "a" or "an" does not exclude a plurality of elements. Moreover, reference signs in the claims shall not be construed as limiting the scope of the claims.

Hereinabove, the invention has been described with reference to specific embodiments. However, the invention is not limited to the various embodiments described but may be amended and combined in different manners as is apparent to a skilled person reading the present specification.

The invention claimed is:

1. A method of processing a stereo signal including left and right signals for reproduction on a 2-channel reproduction system, said method comprising the acts of:

receiving by a processor the left and right signals of the stereo signal and spatial parameters, said left and right signals and said spatial parameters having been formed by an encoder encoding of an N-channel audio signal, N being greater than 2; and processing by the processor said left and right signals of the stereo signal in order to provide processed signals ($L_{0w}$; $R_{0w}$), said processing being controlled in dependence on said spatial parameters (P).

2. The method of claim 1, wherein said processing is controlled by a first parameter ($w_l$; $w_r$) for each of said left and right signals ($L_0$; $R_0$), said first parameter being dependent on the spatial parameters (P).

3. The method of claim 2, wherein said first parameter ($w_l$; $w_r$) is a function of time and/or frequency.

4. The method of claim 2, wherein said processing comprises filtering at least one of said left and right signals ($L_0$; $R_0$) with a transfer function which depends on the spatial parameters (P).

5. The method as claimed in claim 2, wherein said processing comprises:

adding a first, second and third signal in order to obtain said processed signals ($L_{0w}$; $R_{0w}$), in which the first signal includes the stereo signal from a first channel modified by a first transfer function ($L_0$*$H_A$; $R_0$*$H_F$), the second signal includes the stereo signal from the first channel modified by a second transfer function ($L_0$*$H_B$; $R_0$*$H_E$), and the third signal includes the stereo signal of a second channel modified by a third transfer function ($R_0$*$H_D$; $L_0$*$H_C$).

6. The method of claim 5, wherein said second transfer function ($H_B$; $H_E$) comprises a multiplication with said first parameter ($w_l$; $w_r$) followed by multiplication with a first filter function ($H_1$; $H_4$).

7. The method of claim 5, wherein said first transfer function ($H_A$; $H_F$) comprises a multiplication with a second parameter.

8. The method of claim 5, wherein said first transfer function ($H_A$; $H_F$) comprises a multiplication with a second parameter in which said first parameter is a function of said second parameter.

9. The method of claim 6, wherein said third transfer function ($H_l$; $H_D$) comprises a multiplication of the left or right signal ($L_0$; $R_0$) with said first parameter ($w_l$; $w_r$) followed by a second filter function ($H_2$; $H_3$).

10. The method of claim 6, wherein said first filter function is time-invariant.

11. The method of claim 1, wherein said processed signals are described by the equation;

$$\begin{bmatrix} L_{Ow} \\ R_{Ow} \end{bmatrix} = H \begin{bmatrix} L_O \\ R_O \end{bmatrix}$$

in which a transfer function matrix (H) is a function of the spatial parameters (P).

12. The method of claim 11, wherein said transfer function matrix (H) is described by the equation:

$$H = \begin{bmatrix} (1-w_l)^a + (w_l)^a H_1 & (w_r)^a H_3 \\ (w_l)^a H_2 & (1-w_r)^a + (w_r)^a H_4 \end{bmatrix}$$

wherein "a" is a constant, and $H_1$, $H_2$, $H_3$, $H_4$ are filter functions.

13. The method of claim 11, wherein said filter functions ($H_1$, $H_2$, $H_3$, $H_4$) and parameters ($w_l$, $w_r$) are selected so that the transfer function matrix (H) is invertible, wherein the parameters ($w_l$, $w_r$) are dependent on the spatial parameters (P).

14. The method of claim 1, wherein said spatial parameters (P) contain information describing signal levels of the N-channel signal.

15. The method of claim 1, further comprising the act of inverting the processing act to obtain the left and right signals ($L_0$; $R_0$) from the processed signals ($L_{0w}$; $R_{0w}$).

16. A device for processing a stereo signal obtained from an encoder, the stereo signal including left and right signals ($L_0$; $R_0$) reproduction on a 2-channel reproduction system, wherein the encoder encodes an N-channel audio signal into the left and right signals ($L_0$; $R_0$) of the stereo signal and spatial parameters (P), the device comprising:

an input for receiving the left and right signals ($L_0$; $R_0$) of the stereo signal and spatial parameters (P), said left and right signals ($L_0$; $R_0$) and spatial parameters (P) having been formed by an encoding of the N-channel audio signal, N being greater than 2; and a post-processor coupled to said input for post-processing said left and right signals ($L_0$; $R_0$) of the stereo signal in order to provide processed signals ($L_{0w}$; $R_{0w}$), said post-processing being controlled in dependence on said spatial parameters (P).

17. The device of claim 16, further comprising an inverter coupled to the post-processor and configured to invert the processed signals ($L_{0w}$; $R_{0w}$) obtain the left and right signals ($L_0$; $R_0$).

18. The device of claim 17, further comprising a decoder coupled to the inverter and configured to decode the left and right signals ($L_0$; $R_0$) from the inverter into an output N-channel audio signal for output from the decoder.

19. An encoder apparatus comprising:

an encoder for encoding an N-channel audio signal into spatial parameters (P) and left and right signals ($L_0$; $R_0$) of a stereo signal for reproduction on a 2-channel reproduction system, N being greater than 2, and said left and right signals ($L_0$; $R_0$) and spatial parameters (P) being provided at an encoder output; and a post-processor coupled to said encoder output for post-processing said left and right signals ($L_0$; $R_0$) of the stereo signal in order to provide processed signals ($L_{0w}$; $R_{0w}$), said post-processing being controlled in dependence on said spatial parameters (P).

20. An audio system comprising:

an encoder apparatus having an encoder for encoding an N-channel audio input signal into spatial parameters (P) and left and right signals of a stereo signal for reproduction on a 2-channel reproduction system, N being greater than 2, and a device for post-processing said input left and right signals of the stereo signal in order to provide processed signals, said post-processing of the stereo signal being controlled in dependence on said spatial parameters (P); and a decoder apparatus for decoding said processed signals, said decoder apparatus having a device for processing said processed signals, the decoder comprising an inverter configured to invert the post-processing performed in the encoder apparatus in order to provide the stereo signals comprising the left and right signals, and a decoder for decoding the stereo signals into an N-channel output audio signal.

21. A decoder apparatus comprising:

a processor configured to receive processed left and right signals and spatial parameters, wherein the processed left and right signals are left and right signals of the stereo signal post processed in dependence on the spatial parameter, the left and right signals being for reproduction on a 2-channel reproduction system, wherein the left and right signals and spatial parameters represent an encoding of an N-channel audio signal, N being greater than 2, and wherein the processor is further configured to process the processed left and right signals based on the spatial parameters to generate decoder left and right signals; and a decoder configured to decode the decoder left and right signals into a decoder N-channel audio signal.

22. The decoder apparatus of claim 21, wherein the processor processes the processed left and right signals to generate the decoder left and right signals by inverting processing of the left and right signals that had generated the processed left and right signals.

23. A method of decoding comprising the acts of:

receiving by a processor processed left and right signals and spatial parameters, wherein the processed left and right signals are left and right signals of a stereo signal post processed in dependence on the spatial parameter, the left and right signals being for reproduction on a 2-channel reproduction system, wherein the left and right signals and spatial parameters represent an encoding of an N-channel audio signal, N being greater than 2;

processing by the processor the processed left and right signals based on the spatial parameters to generate decoder left and right signals; and decoding by a decoder the decoder left and right signals into a decoder N-channel audio signal for output from the decoder.

24. The method of claim 23, wherein the processing act comprises the act of inverting processing of the left and right signals that had generated the processed left and right signals.

* * * * *